US006817035B2

(12) United States Patent
Park

(10) Patent No.: US 6,817,035 B2
(45) Date of Patent: Nov. 16, 2004

(54) UNIFORM SWEATBAND FOR A CAP

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 44 days.

(21) Appl. No.: 10/099,989

(22) Filed: Mar. 19, 2002

(65) Prior Publication Data

US 2003/0177565 A1 Sep. 25, 2003

(51) Int. Cl.[7] ..... A42B 1/00
(52) U.S. Cl. ..... 2/181
(58) Field of Search ..... 2/181.4, 181.6, 2/182.1, 182.3, 184, 209.12, 181, 209.4; 139/387 R, 387 A

(56) References Cited

U.S. PATENT DOCUMENTS

| | | | | | |
|---|---|---|---|---|---|
| 462,040 | A | * | 10/1891 | Fox | 139/387 R |
| 4,274,157 | A | | 6/1981 | Boden | |
| 4,406,021 | A | | 9/1983 | Bloom | |
| 4,481,681 | A | * | 11/1984 | Hankin | 2/183 |
| 5,327,585 | A | * | 7/1994 | Karlan | 2/7 |
| 5,546,603 | A | | 8/1996 | Lawhorne et al. | |
| 5,553,326 | A | | 9/1996 | Moore | |
| 5,613,248 | A | * | 3/1997 | Young | 2/181.4 |
| 5,822,799 | A | | 10/1998 | Kepple | |
| 5,915,534 | A | | 6/1999 | May | |
| 5,920,910 | A | * | 7/1999 | Calvo | 2/181.4 |
| 5,983,398 | A | | 11/1999 | Kronenberger | |
| 6,016,572 | A | * | 1/2000 | Park | 2/195.2 |
| 6,122,774 | A | * | 9/2000 | Park | 2/181 |
| 6,131,202 | A | * | 10/2000 | Yan | 2/195.3 |
| 6,199,213 | B1 | * | 3/2001 | Whang | 2/181 |
| D452,768 | S | * | 1/2002 | Park | D2/882 |
| 6,363,537 | B1 | * | 4/2002 | Park | 2/181 |
| 6,446,266 | B1 | * | 9/2002 | Park | 2/195.1 |
| 6,493,880 | B1 | * | 12/2002 | Lo | 2/195.2 |
| 6,546,563 | B2 | * | 4/2003 | Young | 2/181 |

* cited by examiner

*Primary Examiner*—Katherine Moran
(74) *Attorney, Agent, or Firm*—Piper Rudnick LLP

(57) ABSTRACT

A baseball-style cap having a sweatband woven to form a tubular channel. The cap includes a crown main body, a visor, and the sweatband. The sweatband is connected to the lower peripheral edge of the crown main body. The tubular weaving of the sweatband reduces manufacturing steps as no sewing of two unjoined ends is necessary. In addition, the sweatband is woven of thread having good moisture absorbency such that subsidiary materials for enhancement of perspiration absorption are not required. The resulting sweatband is uniform in appearance, having the same look on both the inner and outer surfaces, upgrading the quality of the sweatband and enhancing aesthetic appeal.

2 Claims, 2 Drawing Sheets

UNIFORM SWEATBAND FOR A CAP

BACKGROUND OF THE INVENTION

1. Field of the Invention

The present invention is related to the field of caps having visors and, more particularly, to a baseball-style cap with a sweatband having improved appearance and perspiration absorption capability.

2. Description of the Related Art

A baseball style cap generally includes a crown main body, a visor portion that is secured to the forward edge of the crown and extends outwardly therefrom, and a sweatband attached to the lower part of the inside of the crown. The sweatband is constructed from bias-cut fabric sewn together with vinyl and nonwoven fabric to absorb perspiration from the forehead.

Side and cross-sectional views of a conventional sweatband are shown in FIGS. 1 and 1A. As shown, fabric 5 is cut in the bias direction to a desired length and folded to overlap. The overlapping section of fabric is sewn with a row of stitching 6*a* and the other edge of the folded fabric is sewn with a second row of stitching 6*b*. This type of sweatband has an incomplete appearance and also lacks adequate perspiration absorbency.

A second style of conventional sweatband is shown in FIGS. 2 and 2A. As in FIGS. 1 and 1A, the fabric 5 is cut in the bias direction to a desired length. However, in this style, subsidiary materials such as nonwoven fabric 10 and vinyl 11 are layered with the fabric 5 which is then folded over such materials. The overlapping section of fabric is sewn with the materials using two rows of stitching 7*a*, 7*b*. The materials 10, 11 act to improve perspiration absorption, but also increase production cost. Similarly, FIGS. 3 and 3A depict another conventional sweatband having nonwoven fabric 10 incorporated therein and secured with four lines of stitching 8*a*, 8*b*, 8*c*, 8*d*. Like the style shown in FIGS. 2 and 2A, the style depicted in FIGS. 3 and 3A has increased production costs due to the additional material 10, and also results in reduced productivity due to the additional sewing and manhours required to cut and fold the fabric with the subsidiary materials.

Accordingly, a need exists for a cap having a sweatband with improved perspiration absorbency and appearance, which can be constructed efficiently and at low cost.

SUMMARY OF THE INVENTION

In view of the foregoing, one object of the present invention is to provide improved productivity in cap manufacture by eliminating the need for sewing a joint portion of a sweatband.

Another object of the present invention is a cap having a complete appearance which is aesthetically pleasing due to the weaving of a tunnel-shaped sweatband.

Yet another object of the invention is a cap with reduced production requirements, having a sweatband made by weaving of a yarn which has a good perspiration absorbency in itself, thereby eliminating the need to add subsidiary materials which would otherwise be necessary to increase absorbency.

A further object of the present invention is a sweatband for a cap which, through selected stitching, can serve as a guide line for cap manufacturing workers responsible for sewing the sweatband to the lower part of the crown of the cap.

In accordance with these and other objects, the present invention is directed to a cap having a sweatband woven of stretch or non-stretch yarn. The sweatband is woven in a tubular manner so that the resulting fabric is tunnel-shaped, forming a tubular channel, with no need for stitching to form the tube. With this construction, manufacturing is simplified and, due to the good perspiration absorbency of the fabric, no subsidiary materials are necessary.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
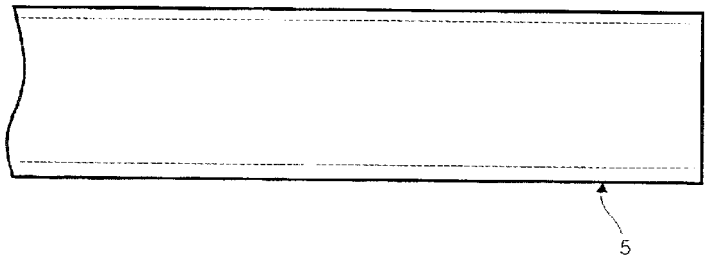
FIG. 1 PRIOR ART
FIG. 1 is a side view of a conventional sweatband.
Figure 1A:
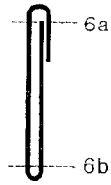
FIG. 1A is an end view of the sweatband of FIG. 1.
Figure 2:
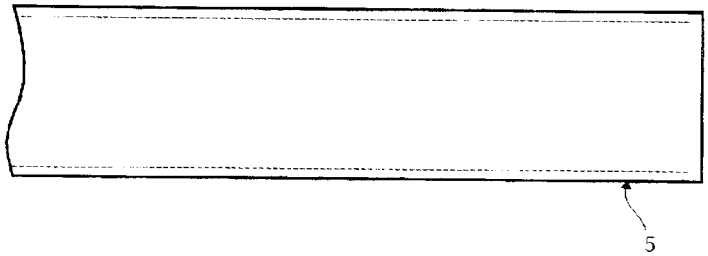
FIG. 2 PRIOR ART
FIG. 2 is a side view of a second style of conventional sweatband.
Figure 2A:
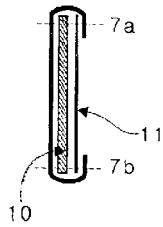
FIG. 2A is an end view of the sweatband of FIG. 2.
Figure 3:
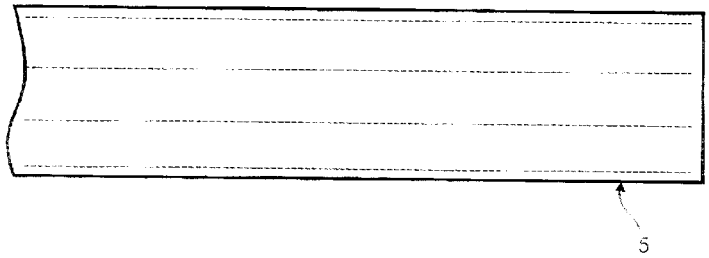
FIG. 3 PRIOR ART
FIG. 3 is a side view of yet another conventional sweatband.
Figure 3A:
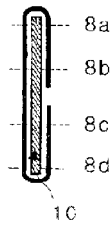
FIG. 3A is an end view of the sweatband of FIG. 3.

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

Figure 4:
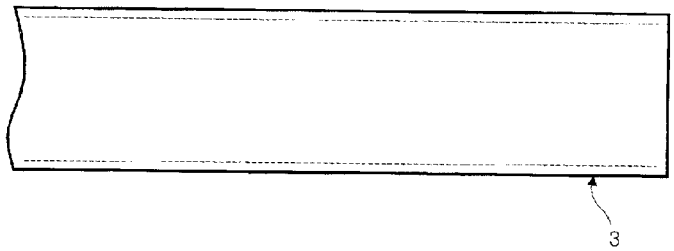
FIG. 4 is a side view of a woven tubular sweatband in accordance with the present invention.
Figure 4A:
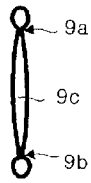
FIG. 4A is an end view of the sweatband of FIG. 4.
Figure 5:
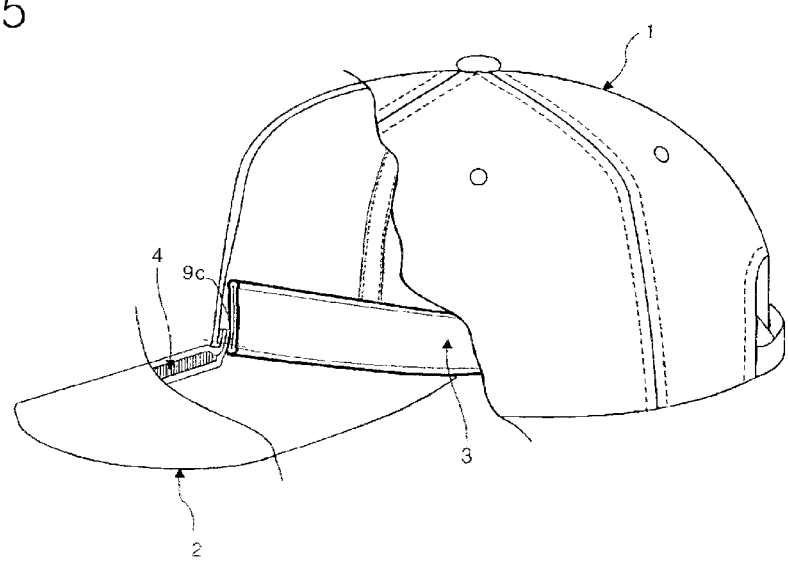
FIG. 5 is a side view with partial cross-section of a cap with the woven tubular sweatband of FIG. 4.

In accordance with a preferred embodiment of the present invention, the present invention is directed to a tubular woven sweatband such as that shown in FIGS. 4 and 4A, for incorporation into a baseball-style cap such as that shown in FIG. 5. As illustrated in the FIG. 5, the cap includes a plurality of fabric segments forming a crown main body 1, a visor portion 2 that is secured to the forward edge of the crown, and a sweatband 3 that is secured to the lower peripheral edge of the interior of the crown. Inside the visor 2, a piece of reinforcing material 4 is inserted between upper and lower fabric portions to maintain the shape of the visor. As shown in FIGS. 4 and 4A, the tubular sweatband is woven of yarn 3 that readily absorbs perspiration. The yarn may be normal spun thread or spun thread having quick moisture absorbency. As shown, preferably only two lines of stitching are used, these two stitching lines being substantially parallel with one another and adjacent the longitudinal edges of the band. Unlike prior art designs, separate sewing of two unjoined ends is not necessary, nor is cutting of the fabric along the bias. Instead, the sweatband is woven to be tubular, forming a central tunnel 9*c*, and is simply cut to the proper length. In addition, because the fabric has good absorbency in itself, no additional fabric or vinyl inserts are necessary to obtain adequate absorption capability. As a result, manufacturers of caps using the inventive sweatband can maximize productivity and minimize production costs. Of course, material which increases absorbency can be added if desired.

While not necessary to join fabric portions, two lines of stitching 9*a*, 9*b* can be sewn along the edges of the sweatband 3. Such stitching serves to reinforce the shape of the sweatband and also provides a guideline for sewing of the sweatband to the crown portion. The result is easier sewing of the sweatband to the inner brim of the crown portion and a neat and clean looking brim line.

The sweatband according to the present invention is uniform in appearance, having the same look on both the inner and outer surfaces, upgrading the quality of the sweatband and enhancing aesthetic appeal.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the tubular sweatband may be incorporated into hats and caps of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. A baseball-style cap with a tubular sweatband comprising:

a crown main body having a plurality of panels and a lower peripheral edge;

a visor portion secured to a forward portion of said peripheral edge of said crown main body and extending outwardly therefrom;

a sweatband sewn along said lower peripheral edge of said crown main body, said sweatband woven of a spun thread material having quick perspiration absorbency to form a tube forming a tubular channel with no need for stitching to form said tube, said tubular channel being flattened and sewn with only two substantially parallel lines, each of said lines extending along and adjacent a respective longitudinal edge of said tubular channel to provide a guideline for attaching the sweatband to the crown main body.

2. A sweatband for use with a baseball-style cap comprising a fabric portion woven of a spun thread material having quick perspiration absorbency to form a tube, with no need for stitching to form said tube, said tube forming a tubular channel such that, when flattened, two layers of said tubular fabric portion provide moisture absorbency and lie against one another when said sweatband is in use, said sweatband being sewn with only two substantially parallel lines of stitching along longitudinal edges thereof to provide a guideline for attaching said sweatband directly to a crown main body of a baseball-style cap.

* * * * *